US005149038A

United States Patent [19]

VanCleve

[11] Patent Number: 5,149,038

[45] Date of Patent: Sep. 22, 1992

[54] MOUNTING DEVICE FOR SMOKE ALARM

[76] Inventor: Richard A. VanCleve, 9N646 Flora Dr., Elgin, Ill. 60123

[21] Appl. No.: 685,729

[22] Filed: Apr. 16, 1991

[51] Int. Cl.[5] ..... A47F 1/10

[52] U.S. Cl. ..... 248/297.2; 340/628

[58] Field of Search ..... 248/297.2, 297.3, 295.1, 248/297.1, 669; 340/521, 546, 628, 409

[56] References Cited

U.S. PATENT DOCUMENTS

| | | | |
|---|---|---|---|
| 1,294,916 | 2/1991 | Knight | 248/297.3 X |
| 2,283,205 | 5/1942 | Harris | 248/297.1 X |
| 3,966,056 | 6/1976 | Larson . | |
| 4,032,707 | 6/1977 | Trenary . | |
| 4,092,641 | 5/1978 | Bellinghausen et al. . | |
| 4,319,234 | 3/1982 | Rice . | |
| 4,484,181 | 11/1984 | Schwartz . | |
| 4,649,376 | 3/1987 | Frank . | |
| 4,702,452 | 10/1987 | Penar | 340/693 X |
| 4,815,734 | 3/1989 | Verhulst | 248/297.2 X |
| 4,862,141 | 8/1989 | Jordal . | |
| 4,887,073 | 12/1989 | Nakao | 340/628 X |
| 4,968,975 | 11/1990 | Fritz | 340/628 |
| 5,007,608 | 4/1991 | Carroll | 248/297.2 |

FOREIGN PATENT DOCUMENTS

| | | | |
|---|---|---|---|
| 2029197 | 3/1980 | United Kingdom | 248/297.2 |

*Primary Examiner*—J. Franklin Foss

*Attorney, Agent, or Firm*—Mathew R. P. Perrone, Jr.

[57] ABSTRACT

A mounting assembly for a smoke alarm, which avoids rendering the smoke alarm inoperable, includes an alarm supporting member having an alarm secured to one end thereof, with the alarm supporting member being fixably and slidably mounted in a wall mount.

20 Claims, 4 Drawing Sheets

FIG. 4
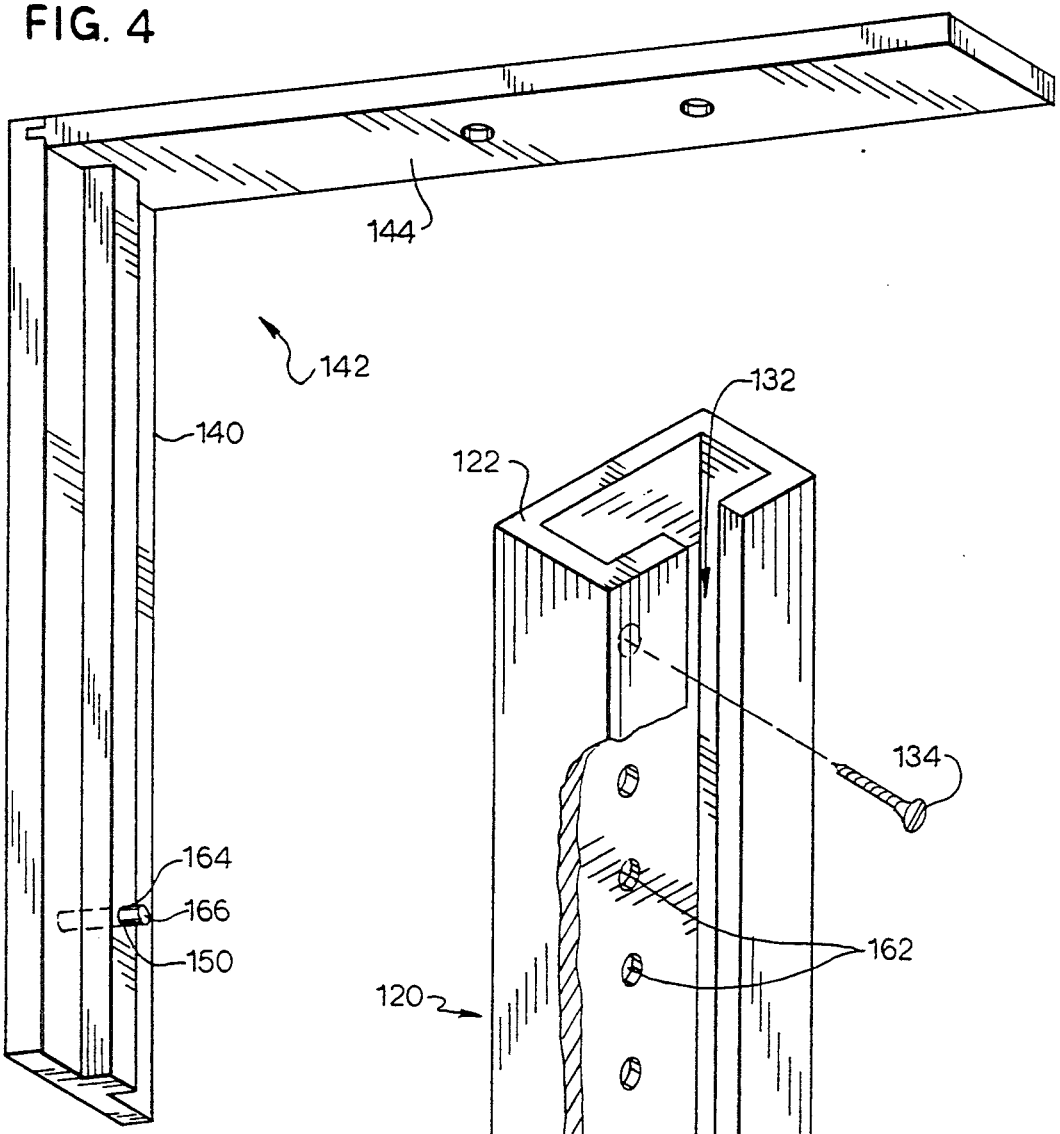
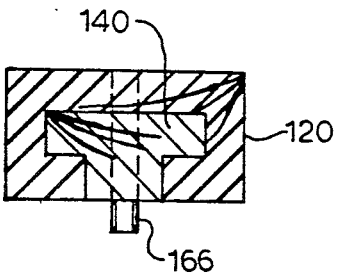
FIG. 5
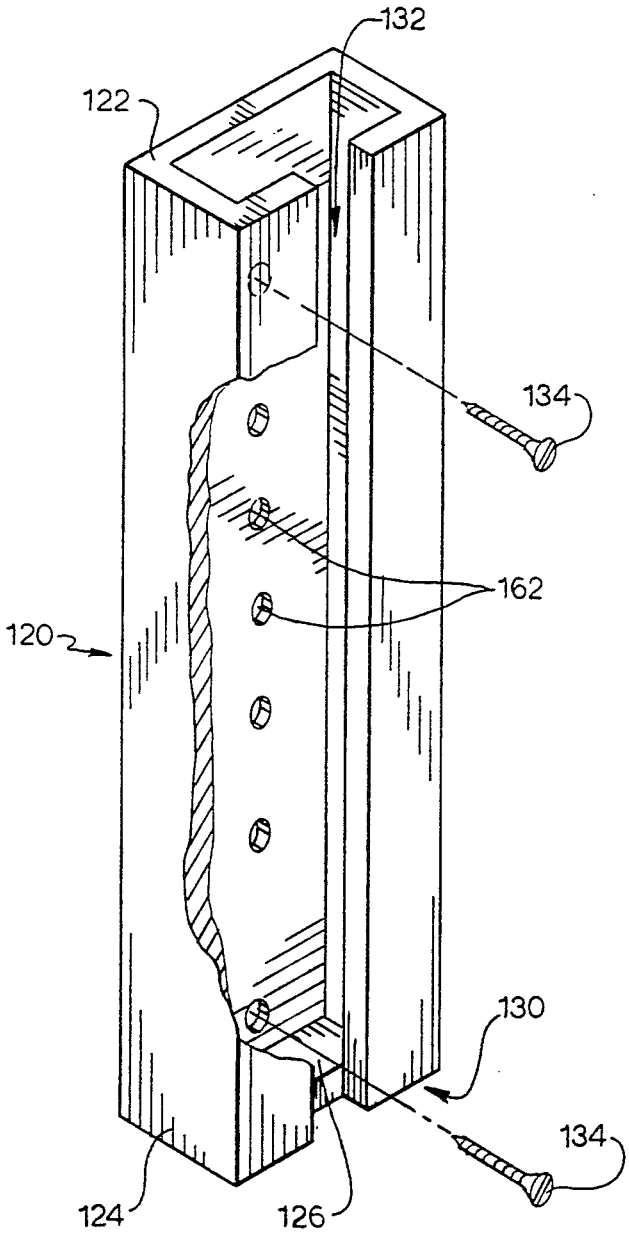
FIG. 3

MOUNTING DEVICE FOR SMOKE ALARM

The invention relates to a mounting device for a smoke alarm or similar device, and more particularly to a mounting device for a smoke alarm or similar device, which can lower the device from the ceiling for repair, replacement of battery or removing from the smoke zone; and then return the alarm to its proper position.

BACKGROUND OF THE INVENTION

A smoke alarm provides great safety for a person in a building. The smoke alarm is activated by smoke or flame to produce a highly disturbing noise capable of waking a person. Such alarms are quite useful during the sleeping time of a person.

It is quite possible for a person to sleep through a fire and not wake up. As a result thereof, the starting of a fire can lead to death from smoke inhalation or burns. In fact, smoke inhalation is a more common form of death in a fire than are burns. A smoke alarm is designed to produce a noise to disturb the sleep and permit a person to vacate the building in suitable time in case of fire. Thus, it is clearly seen that a smoke alarm has great advantages.

However, it is common for a smoke alarm to be activated, when it is not necessary for it to be so activated. For example, when cooking takes place in a home, the heat from the oven or smoke from the cooking can cause the smoke alarm to be activated when not desired. Because it is required to mount the smoke alarm on the ceiling, it is required to climb onto or use a chair, ladder or other suitable device to permit reaching of the smoke alarm in order to deactivate the alarm, during a period when it is activated unnecessarily.

Most alarms are battery powered. As a safety mechanism, the alarm activates when the battery is low. It is also necessary to use a chair or ladder to replace a battery for the smoke alarm. Thus, the activation of the smoke alarm by low battery power causes an annoyance to a person.

It is quite common for a person to overlook the safety factor of a smoke alarm and simply disconnect the battery when these annoyances occur. This is especially true in view of the fact that a ladder or other other similar device must be used to reach most smoke alarms. Furthermore, it is quite common for a person to fail to reinstall a battery in a smoke alarm, thereby rendering the alarm inoperable. It is highly desirable to modify a smoke alarm mount so that the smoke alarm can be easily accessed for terminating undesired activation for whatever reason, while avoiding the necessity of making the smoke alarm inoperable.

SUMMARY OF THE INVENTION

Therefore, among the many objectives of this invention is the objective to provide a mounting assembly for an alarm, which provides for simplified deactivation of the alarm.

A further objective of this invention is to provide a mounting assembly for an alarm, which provides for simplified changing of the battery used by the alarm.

A still further objective of the invention is to provide a mounting assembly for an alarm, which provides for simplified removal of the alarm from smoke.

Yet a further objective of the invention is to provide a mounting assembly for an alarm, which minimizes annoyance to a person.

Also an objective of this invention is to provide a mounting assembly for an alarm, which minimizes battery disconnection.

Another objective of this invention is to provide a mounting assembly for an alarm, which maximizes accessibility to the alarm.

Yet another objective of this invention is to provide a mounting assembly for an alarm, which eliminates the need for a ladder or chair to access the alarm.

Still another objective of this invention is to provide a mounting assembly for an alarm, which simplifies return of the alarm to a ceiling location.

A further objective of this invention is to provide a mounting assembly for an alarm, which provides for simplified changing of the position of the alarm.

A still further objective of the invention is to provide a mounting assembly for a smoke alarm, which avoids rendering the smoke alarm inoperable.

These and other objectives of the invention (which other objectives become clear by consideration of the specification, claims and drawings as whole) are met by providing an alarm supporting member having an alarm secured to one end thereof, with the alarm supporting member being fixably and slidably mounted in a wall mount.

BRIEF DESCRIPTION OF THE DRAWINGS

FIG. 3 depicts a perspective view of the wall mount 120 from the alarm mounting assembly 100 of this invention.

FIG. 4 depicts a perspective view of the smoke alarm mount 140 from the alarm mounting assembly 100 of this invention.

FIG. 5 depicts a cross-section of FIG. 1 along Line 5—5.

Throughout the Figures of drawing where the same part appears in more than one Figure of the drawing, the same numeral is applied thereto.

DESCRIPTION OF THE PREFERRED EMBODIMENTS

This invention provides a mounting device for a smoke alarm. The mounting device includes a wall mounted member capable of receiving an alarm or a smoke alarm mounting member therein. The smoke alarm mounting member is slidably mounted with respect to the wall member. Preferably the smoke alarm mounting member is slidably mounted within the wall member. This permits the wall member to support the alarm in a desired position. It also permits the smoke alarm to be removed from the ceiling and made accessible without a chair or a ladder by simply sliding the smoke alarm mount down the wall mount to provide access to the smoke alarm.

In this fashion, the battery in the smoke alarm can be changed simply. Also when cooking occurs, it is quite possible to slide the smoke alarm down out of the heat or smoke range and achieve the desired results of deactivating the alarm without disconnecting the battery.

Figure 1:
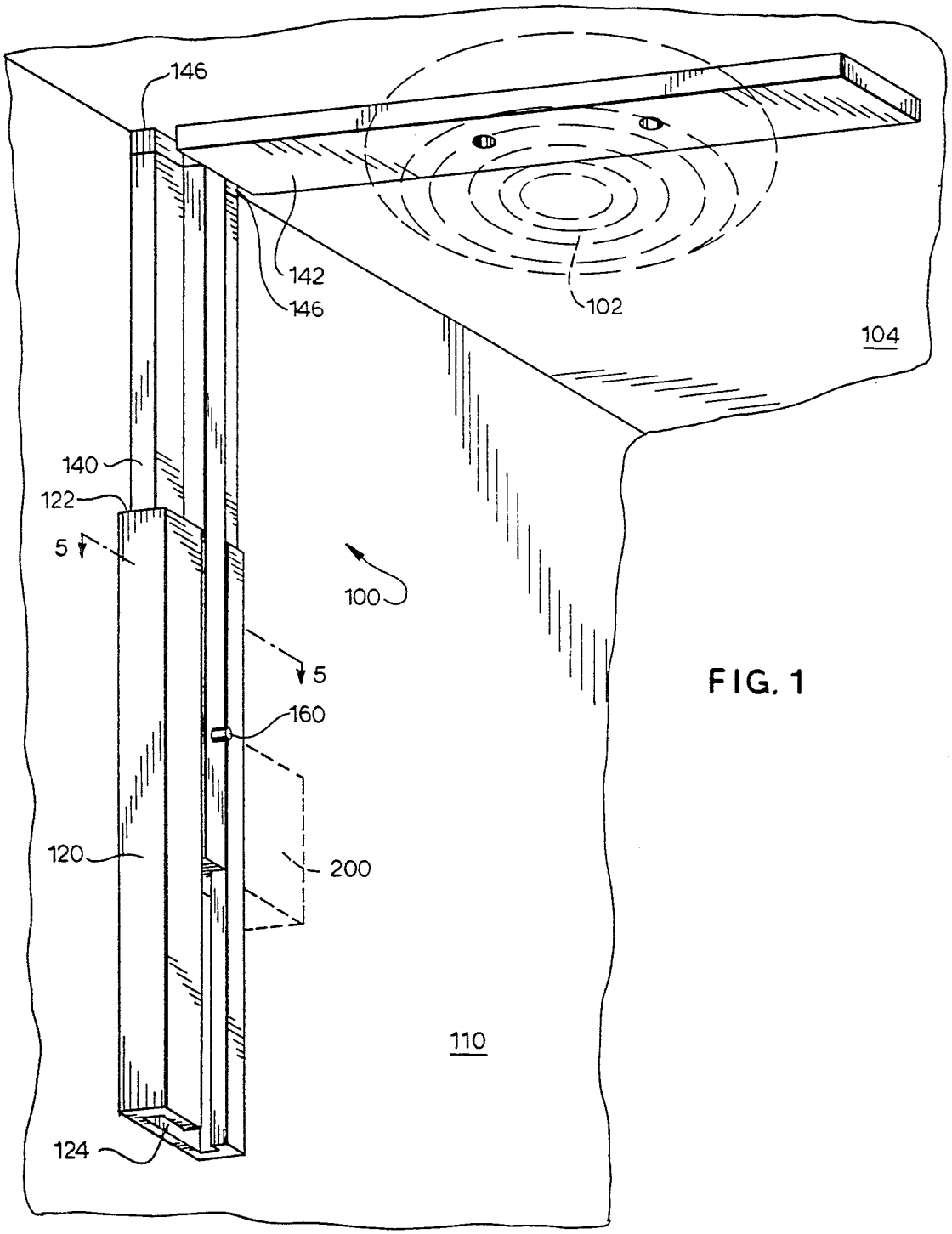
FIG. 1 depicts a perspective view of the alarm mounting assembly 100 of this invention on a wall 110 within a house.

In a preferred fashion, as shown in FIG. 1, the alarm mounting assembly 100 is secured to wall 110 of a house. The smoke alarm 102 or similar device can be positioned adjacent the ceiling 104, or lowered as desired. Desired reasons for lowering include, but are not limited to, changing the battery or minimizing noise during cooking or similar operations when the noise from smoke alarm 102 is not desired. When the cause of the undesired noise is removed, it is a simple matter to return alarm 102 adjacent to ceiling 104 as desired.

Figure 2:
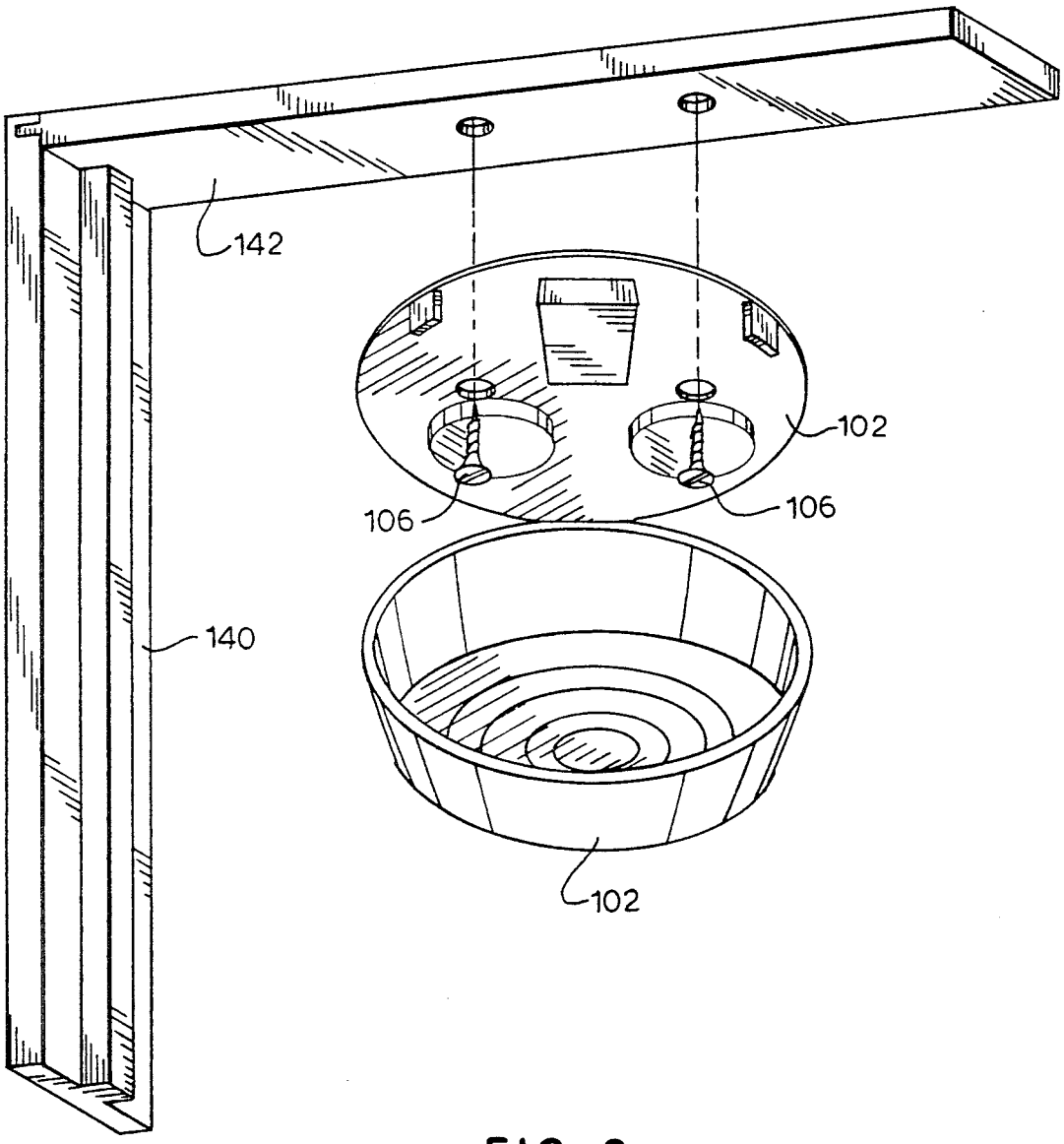
FIG. 2 depicts an exploded, perspective view of the smoke alarm mount 140 with smoke alarm 102 of this invention.

Referring now to FIG. 1 and FIG. 2, the alarm mounting assembly 100 includes a wall mount 120 and a smoke alarm mount 140. Key to the relationship between wall mount 120 and smoke alarm mount 140 is the slidability therebetween, which can be accomplished in many suitable fashions. The wall mount 120 is generally, and preferably U-shaped or C-shaped with respect to top cross-section thereof. The smoke alarm mount 140 is received therein. The smoke alarm mount 140 can then slide upwardly or downwardly, as desired, in the wall mount 120 thereby raising or lowering the smoke alarm as desired.

By considering FIG. 1, and FIG. 3, at a ceiling end 122 of wall mount 120, ceiling 104 may close wall mount 120 depending on how close ceiling end 122 is to ceiling 104. In other words, ceiling end 122 may be mounted adjacent to ceiling 104 to provide that closure.

Receiving end 124 may include block 126 removably secured in wall mount 120 at receiving end 124 by friction or a suitable fastening device. Block 126 holds smoke alarm mount 140 in wall mount 120. Block 126 is optional because pin release mechanism 160 can serve the same closing purpose. Clearly, block 126 can be removably or permanently placed in receiving end 124.

With the U-shape of the wall mount 120, the closed base 130 is generally positioned against wall 110 with the open receiver 132 of the U-shape visible. Into open receiver 132, smoke alarm mount 140 is received. The open receiver 132 may be adjacent to ceiling 104 with an appropriate adjustment smoke alarm mount 140 or spaced therefrom. The length of wall mount 120 can be adjusted in accordance with the height of ceiling 104.

The smoke alarm mount 140 shown in FIG. 2 and FIG. 4, includes a wall member 142 and a ceiling member 144. The smoke alarm 102 is secured ceiling by alarm screws 106 or another suitable fastening means Wall member 142 is shaped to slidably fit into wall mount 120. Ceiling member 144 end to end with wall member 142 in a suitable fashion. Preferably, ceiling member 144 and wall member 142 are secured at a right angle to provide for the standard right angle relationship between ceiling 104 and wall 110.

Figure 6:
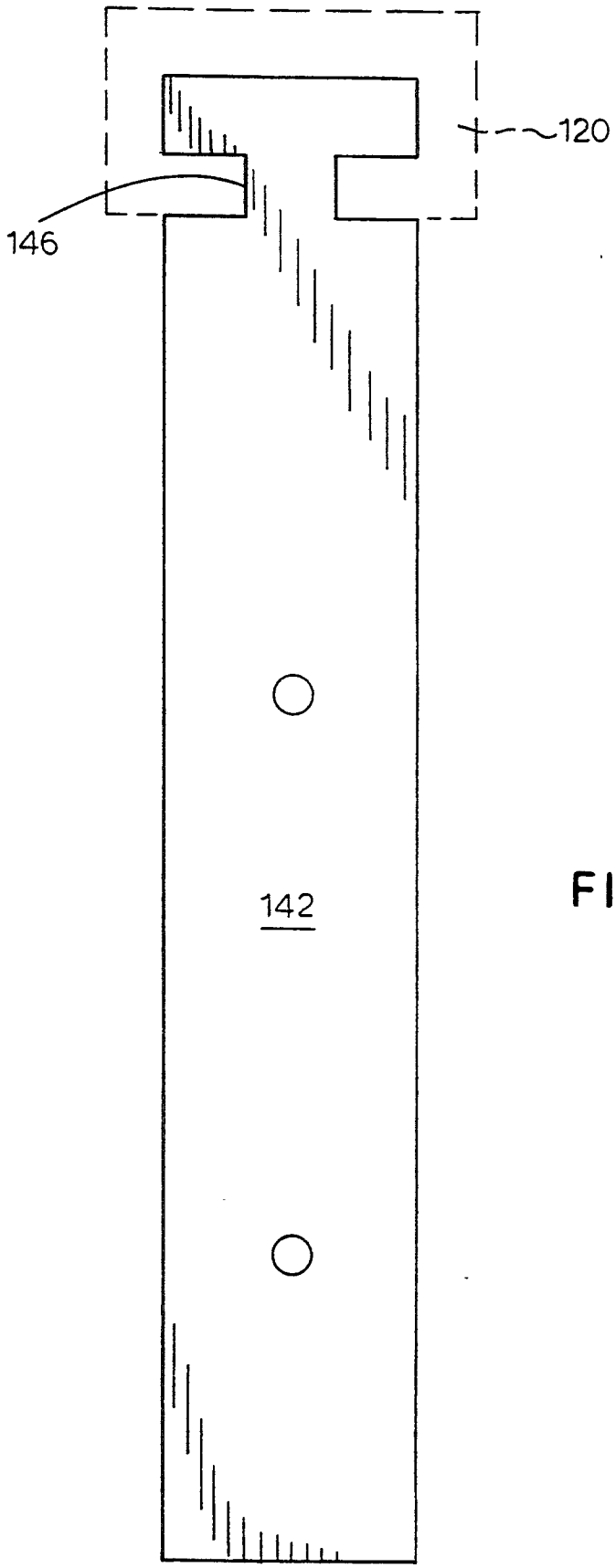
FIG. 6 depicts top plan view of the ceiling mount 144 of the alarm mounting assembly 100 of this invention.

Ceiling member 144 receives smoke alarm 102, which is suitably mounted thereon. As shown in FIG. 1 and FIG. 6, adjacent to wall member 142, ceiling member 144 may have a pair of notches 146 of sufficient size to permit smoke alarm mount to slide completely out of wall mount 120 through receiving end 124. This structure is especially suitable, when the wall mount 120 is C-shaped. Such simplified removal, repair, refinishing, or treatment of the smoke alarm mount 140 or smoke alarm 102 can greatly encourage the use of smoke alarm 102.

A standard timed beeper 200 shown in FIG. 1 can be secured to or placed adjacent to wall mount 120. Beeper 200 can be automatically activated by lowering smoke alarm mount 140, if properly connected. Beeper 200 can also be manually activated whenever smoke alarm mount 140 is lowered to remind a person to raise smoke alarm mount 140 and smoke alarm 102 adjacent to ceiling 104.

This simplified accessibility tends to have a person keep the smoke alarm 102 active and always operational. As such, the position of the smoke alarm 102 can be useful. The sliding of the smoke alarm mount 140 is very effective. When the alarm 102 goes off falsely, the alarm 102 can be moved down the wall mount below the heat level or smoke level to substantially save time for reducing the undesired noise. This idea can also be applied to changing or checking of the battery.

As shown in FIG. 1, FIG. 3, FIG. 4, and FIG. 5, pin release mechanism 160 is preferably employed to reasonably position the smoke alarm 102 at various points as desired. The pin release mechanism 160 permits smoke alarm mount 140 to be positioned within wall mount 120 as desired. The pin release mechanism 160 includes a plurality of pin receiving indentations 162 in wall mount 120. A slidable pin aperture 164 in smoke alarm mount 140 and a pin 166 also form part of the pin release mechanism 160. Pin 166 fits through pin aperture 164 into one of pin indentations 162 to hold smoke alarm 140, where desired.

Pin 166 can be spring loaded and permanently mounted in wall member 142 through slidable pin aperture 164 to fit into pin receiving indentations 162. There may also be more than one pin aperture 164 with pin 166 being completely separable therefrom. When this structure is present, pin 166 is inserted into any desired slidable pin aperture 164, followed by immediately fitting into a desired pin receiving indentation 162. Other positioning devices are usable. Typical examples thereof include a pawl and ratchet mechanism.

The wall mount 120 and smoke alarm mount 140 can be decorated as is appropriate or desired. For example, it is quite easy to make the alarm mounting assembly 100 of a very desirable material, such as oak wood. With an oak mounting, the decoration is achieved while the safety and accessibility of the smoke alarm as desired is maintained.

This device is simply and inexpensively manufactured. It can be modified with a timing device or timed beeper 200 to remind a consumer to replace or raise the smoke alarm 102 after it has been lowered. It can be used in combination with alarms or have an alarm independently attached. Any standard alarm can be used with a minor adjustment of the alarm mounting assembly 100.

It is preferred that the wall mount 120 have a C-shaped cross-section 122 and receive the smoke alarm mount 140 therein. This provides for slidability and flexibility. With oak used as the material therefor, there can be a great deal of efficiency and decorativeness for the alarm mounting assembly 100.

The smoke alarm mount 140 includes a wall member 142 and a ceiling member 144. Wall member 142 is shaped to slidably fit into wall mount 120 in a standard fashion. Ceiling member 144 end to end with wall member 142 in a suitable fashion. Preferably, ceiling member 144 and wall member 142 are secured to each other in a standard fashion at a right angle to provide for the standard right angle relationship between ceiling 104 and wall 110 to provide for mounting of smoke alarm 102.

Also possible is a replacement of ceiling member 144 with a right angle bracket secured at one end of wall member 142. A first arm of right angle bracket is secured at one end of the wall member 142. A second arm of right angle bracket is parallel to the ceiling 110 and has smoke alarm 102 secured thereto to replace ceiling member 144.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An alarm mounting assembly including a wall mount and an alarm mount wherein:

a. said wall mount is secured to a wall;
b. said alarm mount is slidably mounted with respect to said wall mount;
c. said alarm mount includes a fastening means for securing said alarm mount at a certain position within said wall mount;
d. said alarm mount has an alarm secured to an upper portion thereof;
e. said alarm mount provides for raising or lowering of the alarm;
f. said fastening means cooperates with said movable and fixable mounting device;
g. said ceiling is perpendicular to said wall;
h. said alarm mount includes a wall member and a ceiling member;
i. said ceiling member is substantially perpendicular to said wall member;
j. said wall member is slidably mounted within said wall mount;
k. said wall mount has an open end and a closable end;
l. said open end is closer to said ceiling than said closeable end;
m. said closable end is oppositely disposed from said open end;
n. said ceiling member has an alarm means secured thereto; and
o. said closable end includes a blocking member.

2. The alarm mounting assembly of claim 1 wherein said alarm mount includes a movable and fixable mounting device to hold said alarm adjacent to a ceiling.

3. The alarm mounting assembly of claim 2 wherein:

a. said blocking member is removable; and
b. said ceiling member includes a pair of notches adjacent to said wall member in order to permit said alarm mount to be removed from said wall mount through said closable end.

4. The alarm mounting assembly of claim 3 wherein:

a. said closable end receives said removable block to form a closed end; and
b. said wall mount is U-shaped.

5. The alarm mounting assembly of claim 4 wherein said alarm means is a smoke alarm.

6. The alarm mounting assembly of claim 3 wherein:

a. said closable end receives a removable block to form a closed end; and
b. said wall mount is C-shaped.

7. The alarm mounting assembly of claim 6 wherein said alarm means is a smoke alarm.

8. The alarm mounting assembly of claim 3 wherein said open end is adjacent to said ceiling.

9. The alarm mounting assembly of claim 3 wherein:

a. said movable and fixable mounting device includes a pin release mechanism;
b. said pin release mechanism permits said smoke alarm mount to be positioned within said wall mount;
c. said pin release mechanism includes a plurality of pin receiving indentations in said wall mount;
d. said pin release mechanism includes a slidable pin aperture in said smoke alarm mount;
e. said pin release mechanism includes a pin; and
f. said pin fits through said pin aperture into one of said pin indentations to hold said alarm means where desired.

10. The alarm mounting assembly of claim 9 wherein said pin is spring loaded and permanently mounted in said wall member through said slidable pin aperture to fit into one of said pin receiving indentations.

11. The alarm mounting assembly of claim 10 wherein a standard timed beeper is secured adjacent to said wall mount to be activated to remind a person to adjust said alarm mount.

12. An alarm mounting assembly including a wall mount and an alarm mount wherein:

a. said wall mount is secured to a wall;
b. said alarm mount is slidably mounted with respect to said wall mount;
c. said alarm mount includes a fastening means for securing said alarm mount at a certain position within said wall mount;
d. said alarm mount has an alarm secured to an upper portion thereof;
e. said alarm mount provides for raising or lowering of the alarm;
f. said alarm mount includes a movable and fixable mounting device to hold said alarm removably adjacent to a ceiling;
g. said fastening means cooperates with said movable and fixable mounting device;
h. said ceiling is perpendicular to said wall;
i. said alarm mount includes a wall member and a ceiling member;
j. said ceiling member is substantially perpendicular to said wall member;
k. said wall member is slidably mounted within said wall mount;
l. said wall mount has an open end and a closable end;
m. said open end is closer to said ceiling than said closeable end;
n. said closable end is oppositely disposed from said open end;
o. said ceiling member has an alarm means secured thereto; and
p. said closable end includes a blocking member.

13. The alarm mounting assembly of claim 12 wherein said blocking member is removable.

14. The alarm mounting assembly of claim 13 wherein:

a. said closable end receives a removable block to form a closed end;
b. said wall mount is U-shaped; and
c. said alarm means is a smoke alarm.

15. The alarm mounting assembly of claim 13 wherein:

a. said closable end receives a removable block to form a closed end;

b. said wall mount is C-shaped; and c. said alarm means is a smoke alarm.

16. The alarm mounting assembly of claim 15 wherein said alarm means is a smoke alarm.

17. The alarm mounting assembly of claim 13 wherein said open end is adjacent to said ceiling.

18. The alarm mounting assembly of claim 13 wherein:

a. said movable and fixable mounting device includes a pin release mechanism;

b. said pin release mechanism permits said smoke alarm mount to be positioned within said wall mount;

c. said pin release mechanism includes a plurality of pin receiving indentations in said wall mount;

d. said pin release mechanism includes a slidable pin aperture in said smoke alarm mount;

e. said pin release mechanism includes a pin; and f. said pin fits through said pin aperture into one of said pin indentations to hold said alarm means where desired.

19. The alarm mounting assembly of claim 18 wherein said pin is spring loaded and permanently mounted in said wall member through said slidable pin aperture to fit into one of said pin receiving indentations.

20. The alarm mounting assembly of claim 19 wherein a standard timed beeper is secured adjacent to said wall mount to be activated to remind a person to adjust said alarm mount.

* * * * *